US007232358B2

(12) United States Patent
Hung et al.

(10) Patent No.: US 7,232,358 B2
(45) Date of Patent: Jun. 19, 2007

(54) STRUCTURE OF A BAND OF A BRA

(76) Inventors: Shin-Hsien Hung, 2F, No. 31, Desiang Rd., Nanzih District, Kaohsiung City (TW); Ya-Fang Hsu, No. 5, Lane 56, Sishu Rd., South District, Tainan City (TW)

( * ) Notice: Subject to any disclaimer, the term of this patent is extended or adjusted under 35 U.S.C. 154(b) by 128 days.

(21) Appl. No.: 11/094,120

(22) Filed: Mar. 31, 2005

(65) Prior Publication Data

US 2006/0057935 A1 Mar. 16, 2006

(30) Foreign Application Priority Data

Sep. 16, 2004 (TW) ..... 93214770 U

(51) Int. Cl.

| | |
|---|---|
| ***A41C 3/12*** | (2006.01) |
| ***A41C 1/14*** | (2006.01) |
| ***A41D 27/06*** | (2006.01) |
| *A41C 3/00* | (2006.01) |
| *A41D 27/00* | (2006.01) |

(52) U.S. Cl. ..... 450/64; 450/93; 2/255; 2/258

(58) Field of Classification Search ..... 450/64, 450/81, 86, 88, 93, 63, 77, 79, 80, 41–45; 2/255, 256, 258, 260, 238

See application file for complete search history.

(56) References Cited

U.S. PATENT DOCUMENTS

| | | | | | |
|---|---|---|---|---|---|
| 2,524,620 | A | * | 10/1950 | Cadous | 450/41 |
| 2,524,621 | A | * | 10/1950 | Cadous | 450/41 |
| 2,756,435 | A | * | 7/1956 | Rose | 2/255 |
| 3,033,205 | A | * | 5/1962 | Walters | 450/45 |

* cited by examiner

*Primary Examiner*—Gloria Hale
(74) *Attorney, Agent, or Firm*—Rosenberg, Klein & Lee

(57) ABSTRACT

A bra includes two cups, and two bands, which are connected to respective ones of the cups at front ends thereof; each band has two supporting ribs thereon, which are used for helping keep the band smooth; furthermore, each band has a sustaining rib arranged between the two supporting ribs; when the bra is worn on a woman's body with the bands being stretched, passed across the woman's back, and joined together at rear ends, the sustaining ribs will prevent tensional force in the bands from causing deformation of the supporting ribs such that the bra bands will touch the wearer's body closely.

4 Claims, 6 Drawing Sheets

STRUCTURE OF A BAND OF A BRA

BACKGROUND OF THE INVENTION

1. Field of the Invention

The present invention relates to a band of a bra, more particularly one, which has two supporting ribs, and a sustaining rib between the two supporting ribs for reducing the effect of tension of the band on the supporting ribs such that the band will touch a wearer's body closely without having wrinkles or raised areas thereon.

2. Brief Description of the Prior Art

The main purposes of bras are to protect and shape the appearance of a girl's breasts. Good bras should also be comfortable to wear. When a bra is worn on a woman's body, the bands of the bra are prone to have wrinkles and raised areas owing to the tension therein. And, the wrinkles and raised areas of the bra bands will spoil the outline of the woman's back when she wears close-fitting clothes.

Referring to FIGS. 4 and 5, a conventional bra 4 includes two cups 41, and two bands 42, which are connected to respective ones of the cups 41 at front ends thereof. Each of the bands 42 has two supporting ribs 432 thereon for helping keep the band 42 smooth. However, when the bra 4 is worn on a woman's body with the bands 42 being stretched, passed across the woman's back, and joined together at rear ends thereof, the tensional force on the bands 42 will cause deformation of the supporting ribs 43 because the tensional force is in the direction perpendicular to the supporting ribs 43, and because the middle portions of the bands 42 will be subjected to greater tension. Consequently, the bands 42 will have wrinkles and raised areas, which will spoil the outline of her back when she wears close-fitting clothes.

SUMMARY OF THE INVENTION

It is a main object of the invention to provide an improvement on a band of a bra to overcome the above-mentioned problem.

The bra band of the present invention has two supporting ribs thereon for helping keep the band smooth. Furthermore, the band has a sustaining rib arranged between the two supporting ribs. When the bra is worn on a woman's body with the band being stretched, and passed across the woman's back, the sustaining rib will reduce the effect of stretching of the band on the supporting ribs, and in turn tensional force on the band can't cause deformation of the supporting ribs. Consequently, the band will touch the wearer's body closely.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
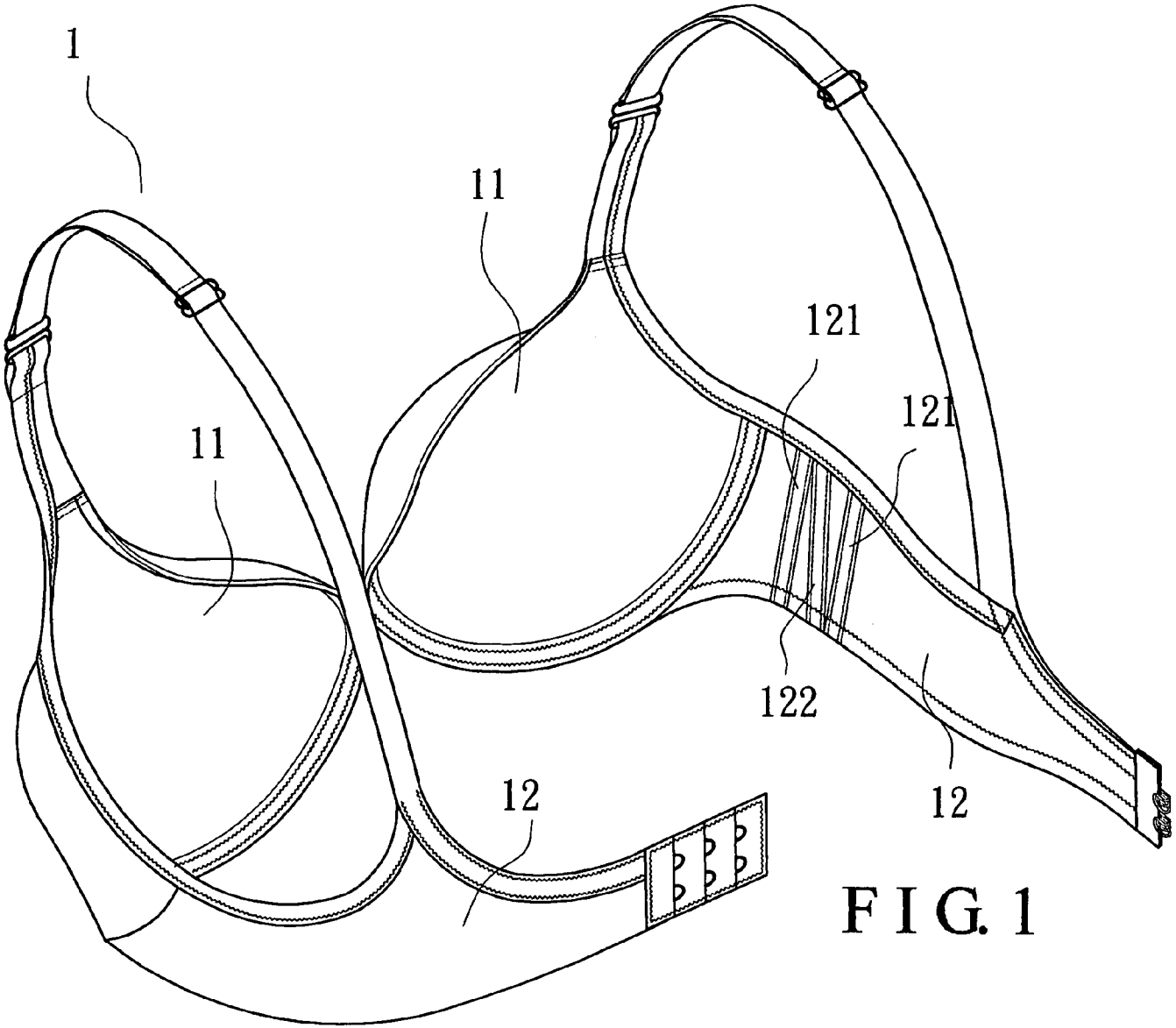
FIG. 1 is a perspective view of the first preferred embodiment of a bra in the present invention.

Referring to FIG. 1, a first preferred embodiment 1 of a bra includes two cups 11, and two bands 12, which are connected to respective ones of the cups 11 at front ends thereof. Each of the bands 12 has two supporting ribs 121 thereon for helping keep the band 12 smooth. Furthermore, each of the bands 12 has a sustaining rib 122, which is arranged between the two supporting ribs 121 in a sloping position, and connected to an upper end of one of the supporting ribs 121 at an upper end thereof, and connected to a lower end of the other supporting rib 121 at a lower end thereof; thus, when the bra 1 is worn on a woman's body with the bands 12 being stretched, passed across the woman's back, and joined together at rear ends thereof, the sustaining rib 122 will help the supporting ribs 121 remain in the original shape, preventing the tensional force on the band 12 from causing deformation of the supporting ribs 121. Therefore, the bands 12 will be smoother, and touch the wearer's body more closely owing to the sustaining rib 122.

Figure 2:
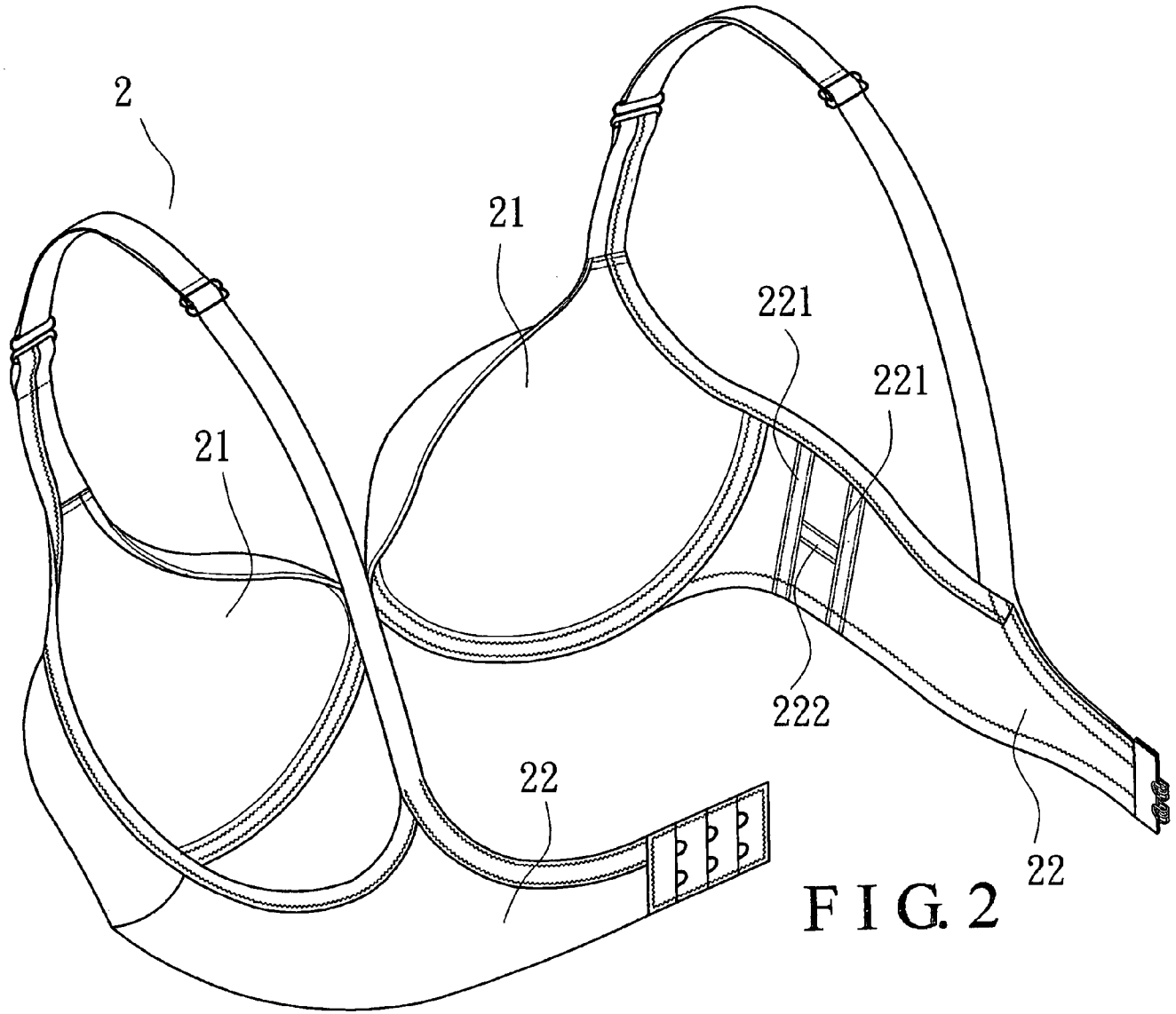
FIG. 2 is a perspective view of the second preferred embodiment.

Referring to FIG. 2, a second preferred embodiment 2 of a bra includes two cups 21, and two bands 22. Each of the bands 22 has two supporting ribs 221 thereon for helping keep the band 22 smooth. Furthermore, each of the bands 22 has a sustaining rib 222, which is arranged between the two supporting ribs 221, and connected to middle portions of the supporting ribs 221 at two ends thereof; thus, when the bra 2 is worn on a woman's body with the bands 22 being stretched, passed across the woman's back, and joined together at rear ends thereof, the sustaining rib 222 will help the supporting 221 remain in the original shape, preventing deformation of the supporting ribs 221. Therefore, the bands 22 won't have wrinkles or raised areas on the wearer's back, and they will touch the wearer's body more closely.

Figure 3:
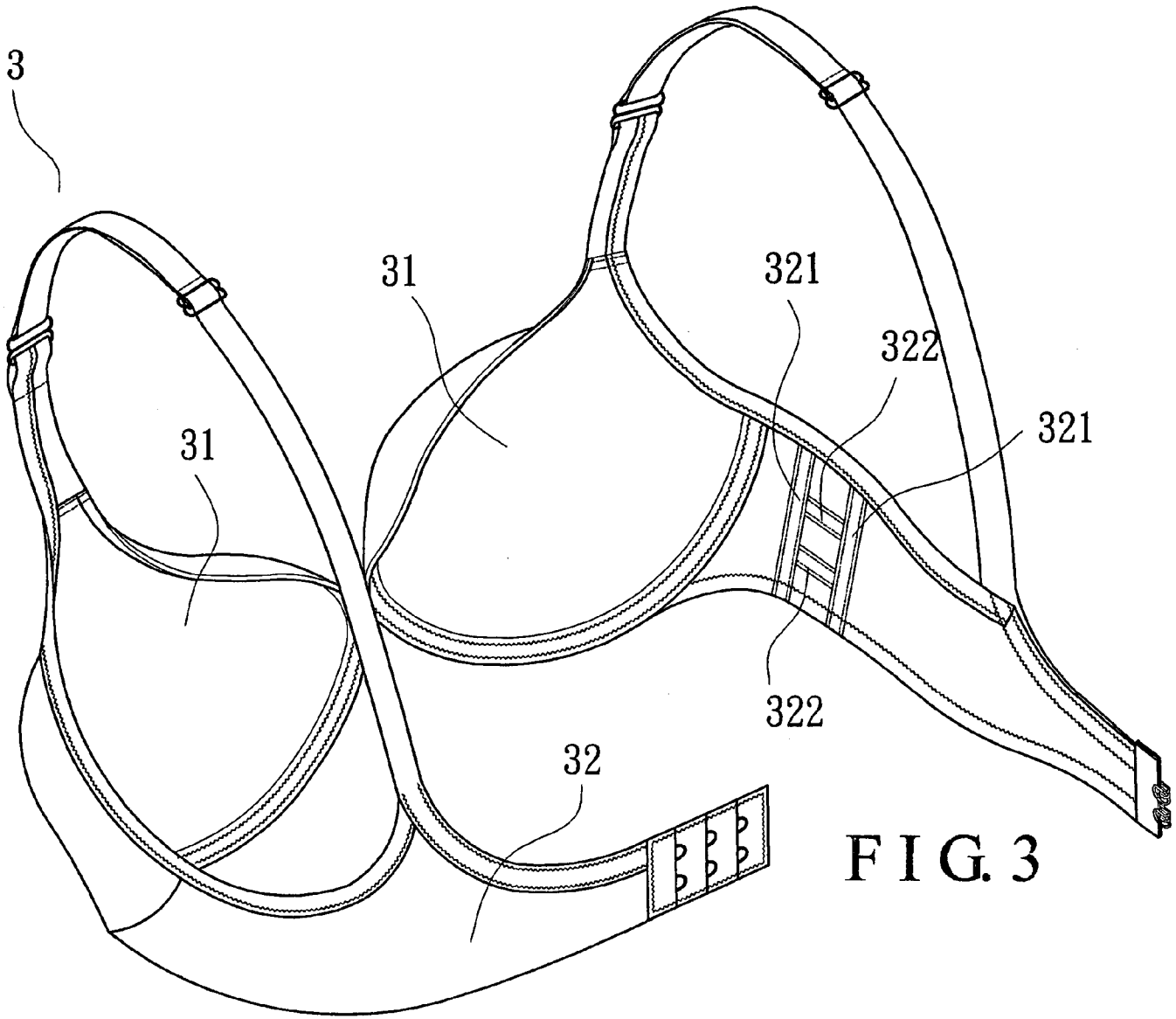
FIG. 3 is a perspective view of the third preferred embodiment.
Figure 4:
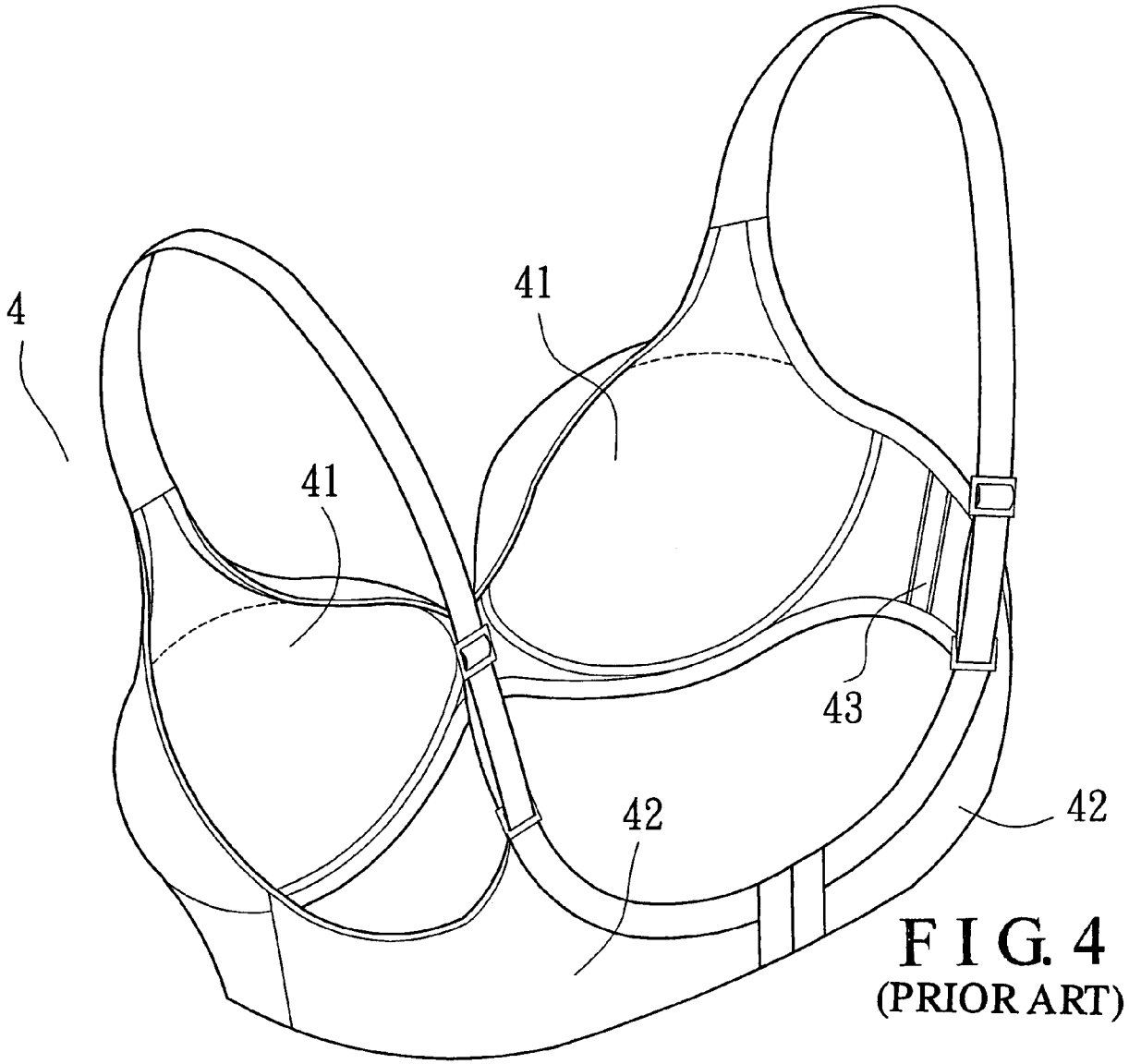
FIG. 4 (PRIOR ART)
FIG. 4 is a perspective view of the conventional bra described in Background.
Figure 5:
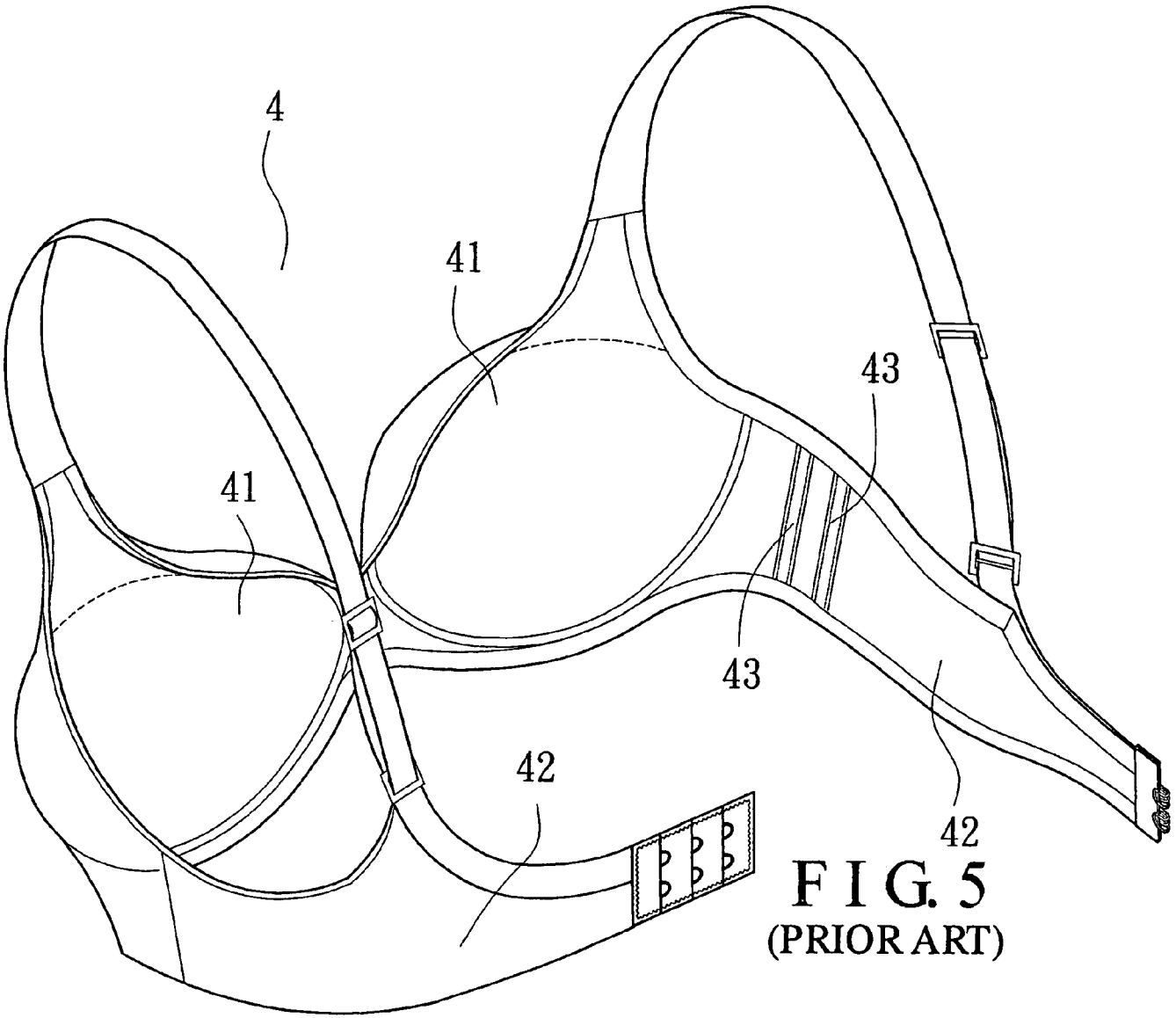
FIG. 5 (PRIOR ART)
FIG. 5 is another perspective view of the conventional bra.
Figure 6:
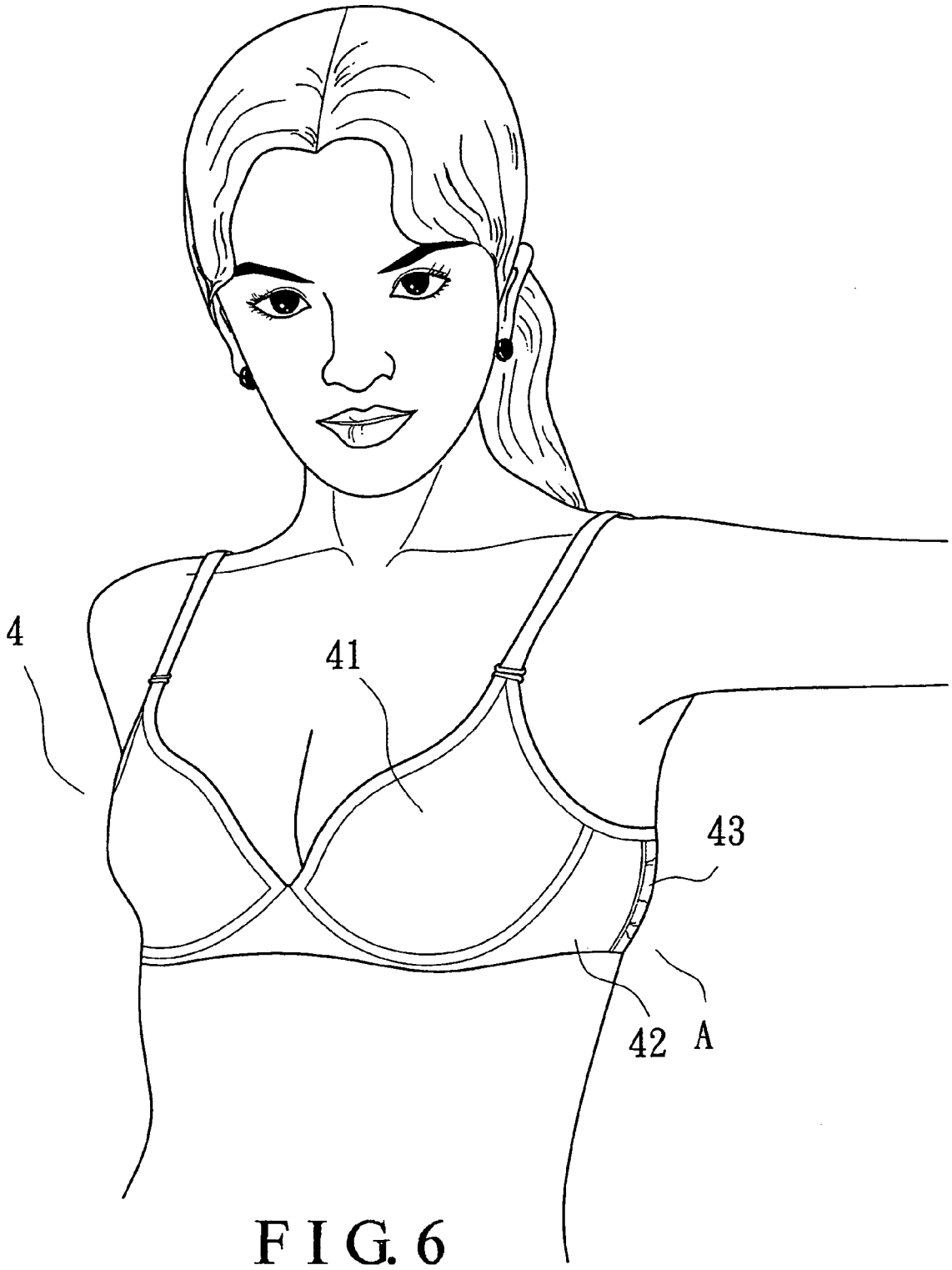
F I G. 6 (PRIOR ART)
FIG. 6 is a view of the conventional bra worn on a woman.

Referring to FIG. 3, a third preferred embodiment 3 of a bra includes two cups 31, and two bands 32. Each of the bands 32 has two supporting ribs 321 thereon for helping keep the band 32 smooth. Furthermore, each of the bands 32 has several sustaining ribs 322, which are spaced apart between and perpendicular to the two supporting ribs 321, and connected to the supporting ribs 321 at two ends thereof; thus, when the bra 3 is worn on a woman's body with the bands 32 being stretched, passed across the woman's back, and joined together at rear ends thereof, the sustaining ribs 322 will help the supporting ribs 321 remain in the original shape, preventing deformation of the supporting ribs 321. Therefore, the bands 32 won't have wrinkles or raised areas on the wearer's back, and they will touch the wearer's body more closely.

From the above description, it can be easily understood that the bra band of the present invention has the following advantages:

1. When the bra is worn on a woman's body with the bands being stretched, the sustaining ribs will keep the supporting ribs in a stretched position, preventing deformation of the supporting ribs. Therefore, the bra bands won't have wrinkles or raised areas.

2. The bra bands will be relatively smooth and touch the wearer's back closely, and in turn they won't have wrinkles or raised areas to spoil the outline of the wearer's back when she wears close-fitting clothes.

What is claimed is:

1. A band of a bra, the band being connected to a corresponding cup of a bra; the band comprising:

two supporting ribs disposed thereon, which are used for helping keep the band smooth; and a sustaining rib arranged on the band between the two supporting ribs for preventing tensional force on the band from causing deformation of the supporting ribs such that the band will touch a wearer's body closely;

wherein the sustaining rib is arranged between the two supporting ribs in a sloping position, and extending from an upper end of one of the supporting ribs to a lower end of the other of the supporting ribs.

2. A bra band connected to a corresponding cup of a bra; the band comprising:

two supporting ribs disposed thereon for helping to keep the band smooth; and a sustaining rib arranged on the band between the supporting ribs for preventing tensional force on the band from causing deformation of the supporting ribs such that the band will touch a wearer's body closely;

wherein the sustaining rib is arranged between the two supporting ribs, and connected at two ends thereof to middle portions of the supporting ribs.

3. A band of a bra, the band being connected to a corresponding cup of a bra; the band comprising:

two supporting ribs thereon, which are used for helping keep the band smooth; and a plurality of sustaining ribs arranged to extend transversely between the two supporting ribs from one supporting rib to the other for preventing tensional force on the band from causing deformation of the supporting ribs such that the band will touch a wearer's body closely.

4. The bra band as claimed in claim 3, wherein the sustaining ribs are spaced apart and perpendicular to both of the supporting ribs, the sustaining ribs being connected at two ends thereof to the supporting ribs.

* * * * *